United States Patent [19]

Gidlund

[11] 4,355,564

[45] Oct. 26, 1982

[54] PNEUMATIC RECIPROCATING MECHANISM

[75] Inventor: Per L. A. Gidlund, Täby, Sweden

[73] Assignee: Atlas Copco Aktiebolag, Nacka, Sweden

[21] Appl. No.: 134,761

[22] Filed: Mar. 28, 1980

[30] Foreign Application Priority Data

Mar. 30, 1979 [SE] Sweden ..... 7902873

[51] Int. Cl.[3] ..... F01B 15/02; F01L 21/02

[52] U.S. Cl. ..... 91/217; 91/325; 91/398; 91/410; 92/240

[58] Field of Search ..... 91/410, 232, 217, 342, 91/50, 402, 398, 325; 92/240

[56] References Cited

U.S. PATENT DOCUMENTS

| | | | |
|---|---|---|---|
| 1,264,168 | 4/1918 | Elvin et al. | 91/410 |
| 2,489,715 | 11/1949 | Mark, Jr. et al. | 92/240 |
| 2,556,680 | 6/1951 | Davis | 91/342 |
| 2,649,076 | 8/1953 | Dupre | 91/410 |
| 3,994,208 | 11/1976 | Boyer | 92/240 |
| 4,088,062 | 5/1978 | Nilsson et al. | 91/50 |
| 4,117,764 | 10/1978 | Nilsson et al. | 91/217 |

*Primary Examiner*—Paul E. Maslousky

*Attorney, Agent, or Firm*—Frishauf, Holtz, Goodman and Woodward

[57] ABSTRACT

A pneumatic reciprocating mechanism comprising a working member (11) reciprocably powered in a housing (10) and forming together with a vibration absorbing reaction support member (12) and an elastic seal element (47) a working chamber (49) which is supplied with pressure via an air feed valve (54,55). The latter is positively coupled to the working member (11) and controls the air flow through openings (54) in the reaction support member (12) in response to the relative positions of the working member (11) and the reaction support member (12).

The elastic seal element (47) is associated with the working member (11) and has an annular valve collar (48) which is arranged to establish sealing contact with a diverging peripheral wall (52) of the reaction support member (12) by radial expansion due to the air pressure in the working member (49).

8 Claims, 4 Drawing Figures

PNEUMATIC RECIPROCATING MECHANISM

BACKGROUND OF THE INVENTION

This invention relates to a pneumatic reciprocating mechanism. In particular the invention concerns a reciprocating mechanism of the type having a reciprocable working member which together with a reaction support member defines a pressure air supplied working chamber. The working member is balanced by, on one hand, the pressure in the working chamber, and on the other hand the action of a spring.

In U.S. Pat. No. 2,432,877 there is shown a pneumatic impact tool including a reciprocating mechanism of the above described type. This prior art device comprises a reciprocable working member equipped at its forward end with a chisel bit and is spring biased toward an apertured resilient diaphragm. The pressure from a continuously pressure air supplied working chamber acts upon the working member and moves it forward. The diaphragm is arranged to control the air outlet from the working chamber in response to the position of the working member.

The diaphragm of this prior art device is exposed to an unacceptable hard wear due to a large deflection magnitude during working. The above mentioned device is disadvantageous also as regards outer dimensions because the diaphragm is clamped to the tool by a cap the outer diameter of which is very large compared to the effective pressurized area of the working member. This is of great importance when using the reciprocating mechanism in hand held tools which should be as slender and light as possible.

The object of the present invention is to create an improved reciprocating mechanism in which the above mentioned problem is solved.

SUMMARY OF THE INVENTION

In accordance with the invention, a pneumatic impact mechanism comprising a working member (11) reciprocably guided in a housing (10) and balanced between a spring (32) and a pressure air supplied working chamber (49), the working chamber (49) being defined by the rear end portion (29) of the working member (11), a reaction support member (12) and an elastic seal element (47) located between the working member (12) and the reaction support member (12). The seal element (47) comprises an annular axially extending valve collar (48) which is radially expandible by the air pressure in the working chamber (49) to an outer diameter exceeding its nominal outer diameter; and the reaction support member (12) comprises a depression (51) located coaxially with the radially expandible valve collar (48), the depression (51) having an inner peripheral wall (52) of a diameter exceeding the nominal outer diameter of the radially expandible valve collar (48); the radially expandible valve collar (48) during each reciprocation cycle of the working member (11) entering the depression (51) and by radial expansion therein establishing an air tight seal with the peripheral wall (52) of the depression (51).

DETAILED DESCRIPTION

Figure 1:
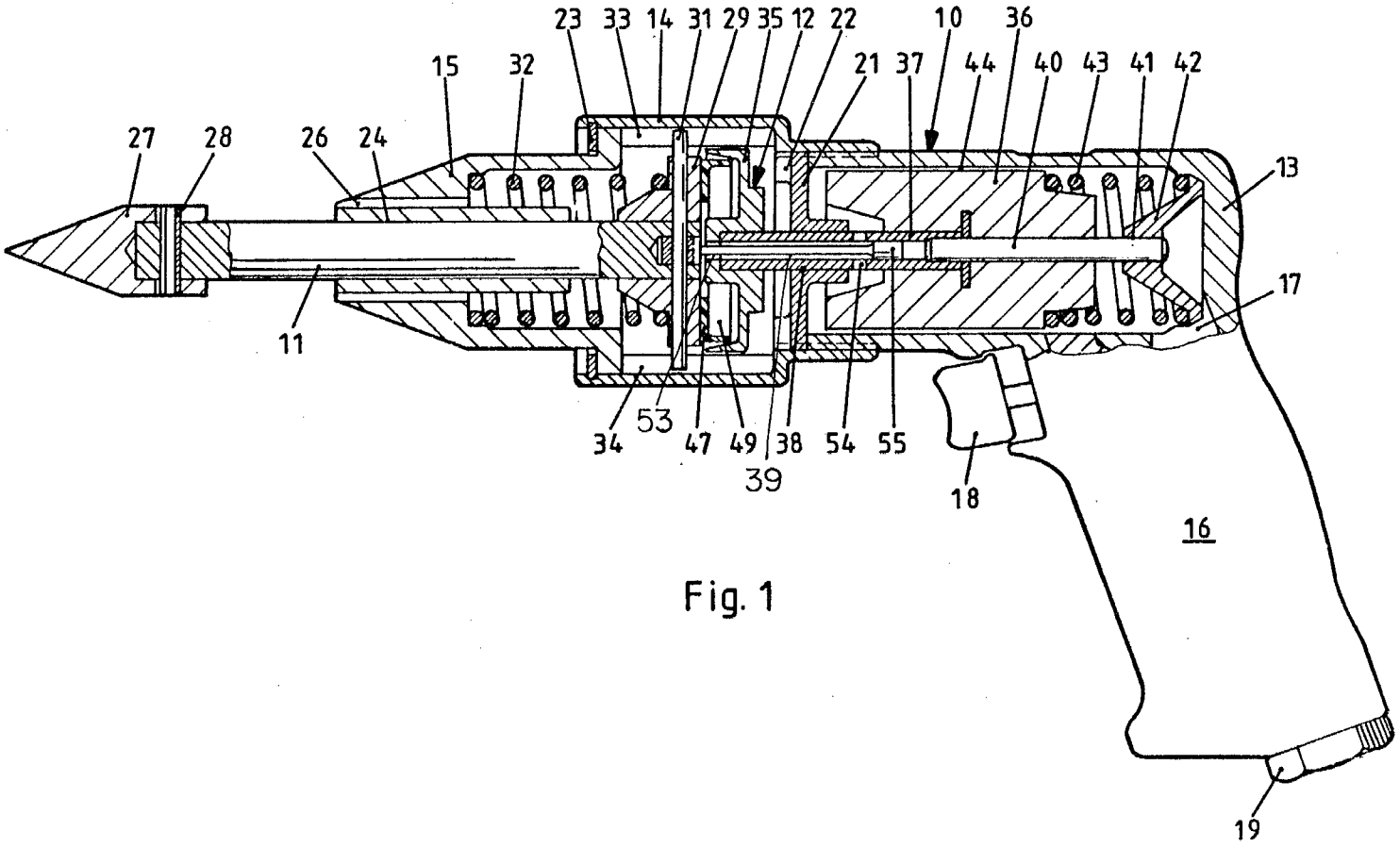
FIG. 1 shows, partly in section, a side elevation of a hand tool including a reciprocating mechanism according to the invention.

The impact tool shown in FIG. 1 is a light chisel driving pneumatic tool provided with a piston grip at its rear end. The tool comprises a housing 10, a reciprocating working member 11 and a reaction support member 12.

The tool housing 10 comprises three main parts, namely a rear section 13, an intermediate section 14 and a front section 15. The rear section 13 is formed in one piece with a pistol grip 16 by which the tool is supported by the operator. The pistol grip 16 includes a pressure air supply passage 17, a throttle valve (not shown) operated by a trigger 18 and a nipple 19 for connection of a pressure air supply conduit.

The intermediate housing section 14 is threaded onto rear section 13, and a transverse wall 21 is clamped between the forward end of the rear section 13 and an inner shoulder 22 on the intermediate section.

The front section 15 is received in the forward end of the intermediate section 14 and is locked thereto by a lock ring 23. The front section 15 is provided with an axially extending bore 24 for guidingly supporting working member 11. The front section 15 also comprises a pair of forwardly directed air outlet passages 26.

At its forward extremity, the working member 11 is provided with a chisel bit 27. The latter is positively locked thereto by means of a transverse split pin 28. At its rear end, the working member 11 carries an activation head 29. The latter is secured to the working member 11 by a transverse lock pin 31. A compression spring 32 is inserted between the activation head 29 and the front section 15 of the housing 10 so as to apply a rearwardly directed biasing force on the working member 11. The lock pin 31 extends in opposite directions laterally beyond the head 29 to engage two longitudinally extending grooves 33, 34 in the intermediate section 14 of the housing 10, thereby preventing the working member 11 from rotating relative to the housing 10.

In the illustrated tool, the reaction support member 12 is reciprocably guided relative to the housing 10. The reaction support member 12 comprises a reaction head 35, a high inertia balancing weight 36, and a hollow stem 37 rigidly interconnecting the reaction head 35 and the balancing weight 36. Preferably, the balancing weight 36 is made of lead in order to obtain a high as possible inertia. The stem 37 is longitudinally guided in a central opening 38 of the transverse wall 21 and forms an axial air passage 39. A guide pin 40 is rigidly secured relative to the balancing weight 36 and extends rearwardly therefrom to be guidingly received in a central bore 41 of a conical support element 42. The latter is located at the bottom of the rear housing section 13 and forms a reaction support for a compression spring 43 the opposite end of which takes support against the rear end of the balancing weight 36.

The reaction support member 12 is displaceably guided relative to the housing 10 by its hollow stem 37 cooperating with the central opening 38 of the transverse wall 21 and by its guide pin 40 cooperating with the central bore 41 of the support element 42. This means that the balancing weight 36 is kept out of any contact with the inside wall of the housing section 13. Instead, there is left an annular space 44 between the balancing weight 36 and section 13 for communicating pressure air from passage 17 in the handle 16 to the forward end of weight 36.

The activation head 29 of the working member 11 is formed with a flat rear end surface 46 for axially supporting an elastic seal element 47. (See FIGS. 2–4). The latter has a flat back surface which is kept in continuous contact with surface 46 of the activation head 29 just by the action of pressure air. The seal element 47 is formed with an annular rearwardly extending valve collar 48 for sealing cooperation with the reaction head 35 of the reaction support member 12, as described below.

Between the activation head 29, the reaction head 35 of the reaction support member 12 and the seal element 47 there is formed a working chamber 49. In order to give the latter a suitable volume and to match the shape of the seal element 47, the reaction head 35 is provided with an annular depression 51 which is coaxial with the seal element 47 and defined by an inwardly facing, peripheral wall 52. The latter diverge by a small angle toward the seal element 47 and has a minimum diameter slightly exceeding the nominal outer diameter of the valve collar 48. In its central part, the reaction head 35 is provided with an axial opening 53 communicating with the longitudinal passage 39 of stem 37, and, via a couple of lateral openings 54 in stem 37, the working chamber 49 is able to communicate with the annular space 44 and the air supply passage 17.

In order to control the pressure air supply to the working chamber 49, there is provided a feed valve operating within the longitudinal passage 39 of the stem 37 to control the air flow through the lateral openings 54. The feed valve comprises a cylindrical element 55 sealingly guided in passage 39 and coupled to the working member 11 by means of a rod 56 extending through passage 39. Rod 56 is of a considerably less diameter than passage 39 and is secured relative to the working member 11 by the transverse lock pin 31.

The operation order of the shown chisel driving tool will hereinafter be described with reference to the drawings.

As a pressure air conduit is connected to nipple 19 and trigger 18 is pulled, pressure air enters the rear end of section 13 of the housing 10 via air supply passage 17. The pressure air passes the annular space 44 between the balancing weight 36 and the housing section 13 and reaches the lateral openings 54 of stem 37.

Under the assumption that the impact mechanism from the start occupies its rest position as illustrated in FIG. 1, i.e. the working member 11 and the reaction support member 12 occupy their closest positions under the action of springs 32 and 43, a full operation cycle will be described. In this position, the feed valve element 55 does not at all restrict the openings 54 which means that pressure air unrestrictedly enters and follows passage 39 and reaches the working chamber 49 through opening 53 in reaction head 35.

Figure 2:
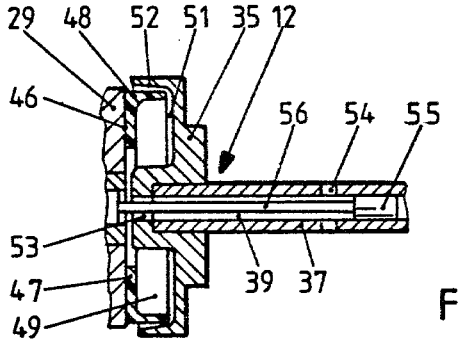
FIG. 2 shows, on a larger scale, the working member, the reaction support member and the elastic seal element of the device in FIG. 1, the working member being illustrated in its rearmost position in which the air feed valve is fully open.
Figure 3:
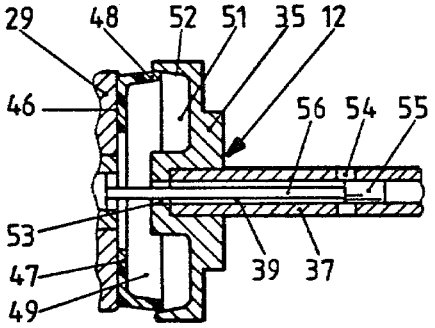
FIG. 3 shows the same details as FIG. 2 but illustrates the working member during acceleration forwards.

As best seen in FIGS. 2 and 3, as the working chamber 49 is pressurized, the valve collar 48 of the elastic seal element 47 is urged outwardly into sealing contact with the peripheral wall 52 of the reaction head 35. The pressure within the working chamber 49 now increases rapidly and a driving force upon activation head 29 is obtained and a work stroke of the working member 11 is commenced.

Due to the pressure in the working chamber 49, the working member 11 is moved forwards against the action of spring 32, and since the pressure acts upon the reaction head 35 as well, the reaction support member 12 starts to move backwards against the action of spring 43. Since the mass of the working member 11 is much less than that of the reaction support member 12 (which includes weight 36), the acceleration of the working member 11 is much higher.

During the separation movement of the working member 11 and the reaction support member 12, the valve collar 48 of the seal element 47 maintains its sealing contact with the peripheral wall 52, and as the latter is conically diverging, the valve collar 48 is expanded successively by the air pressure to a diameter exceeding its normal outer diameter (see FIG. 3).

When the working and reaction support members 11 and 12, respectively, have reached the positions illustrated in FIG. 3, the sealing contact between the valve collar 48 and the peripheral wall 52 cannot be maintained any longer, and a sudden pressure drop occurs as the pressure air is able to rush out through the large area gap formed between the parting members.

In order to prevent pressure air from just rushing through the working chamber 49 during this venting sequence of the working cycle, the feed valve 55 has already cut off the air supply path by covering the openings 54. In this way, the feed valve is able to effectively reduce the air consumption of the tool.

Figure 4:
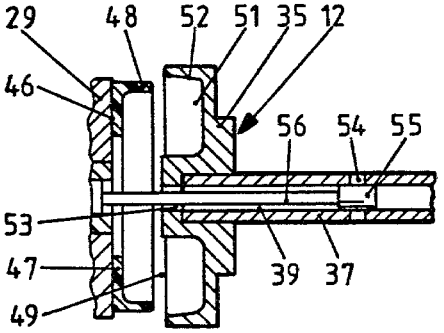
FIG. 4 shows the same details as FIG. 2 but illustrates the working member in its forwardmost position in which the air feed valve is fully closed.

In the position shown in FIG. 4, the sealing contact between valve collar 48 and the peripheral wall 52 is broken, the pressure air supply to the working chamber 49 is cut off by valve 55 and the valve collar 48 of the seal element 47 has reassumed its nominal diameter. In this position, the work stroke is over and the working member 11 and the reaction support member 12 start moving towards each other under the action of springs 32 and 43.

When the working member 11 and the reaction support member 12 come close together, the pressure within the working chamber 49 rapidly increases. This is due partly to compression of the air being left between the two parts and partly to the fact that feed valve 55 is reopened allowing pressure air to enter the working chamber 49. When the pressure drop across the rim of the valve collar 48 reaches a certain magnitude, the valve collar 48 is expanded to reassume its sealing contact with the peripheral wall 52 of the reaction head 35. A full working cycle is thereby completed.

The exhaust air leaving the working chamber 49 during operation of the mechanism is collected in the intermediate section 14 of the housing 10 and leaves the tool via the outlet openings 26 in the front housing section 15.

The characteristic feature of the reciprocating mechanism according to the invention is the feed valve being employed in the pressure air supply passage so as to obtain a reduction of the air consumption in relation to previous devices without affecting the output power of the device.

During tests, we have observed a reduction of as much as 30% of the pressure air consumption when utilizing a reciprocating mechanism according to the invention instead of a prior art device.

It is to be understood that the embodiments are not limited to the shown and described example. For instance, a mechanism designed in accordance with the invention is not limited to vibration damped embodiments including reciprocating support members. Neither is the invention limited to the seal element design of the disclosed embodiment.

I claim:

1. In a pneumatic impact mechanism, comprising a working member (11) reciprocably guided in a housing (10) and balanced between a spring (32) and a pressure air supplied working chamber (49); the working chamber (49) being defined by a rear end portion (29) of the working member (11), a reaction support member (12) and an elastic seal element (47) located between the working member (11) and the reaction support member (12), the improvement wherein:

the seal element (47) comprises an annular axially extending valve collar (48) which is radially expandible by the air pressure in the working chamber (49) to an outer diameter exceeding its nominal outer diameter; and the reaction support member (12) comprises a depression (51) located coaxially with said radially expandible valve collar (48), said depression (51) having an inner peripheral wall (52) conically diverging in the working stroke direction of said working member (11), and having at its forward end facing the seal element (47) a diameter exceeding the nominal diameter of said radially expandible valve collar (48);

said radially expandible valve collar (48) during each reciprocation cycle of the working member (11) entering said depression (51) and by radial expansion therein establishing an air tight seal with said peripheral wall (52) of said depression (51).

2. Impact mechanism according to claim 1, wherein the rear end portion (29) of the working member (11) comprises a substantially flat rearwardly facing surface (46), and said seal element (47) is kept in continuous association therewith by the action of the pressure in the working chamber (49) only.

3. Impact mechanism according to claim 1, wherein said reaction support member (12) comprises a vibration absorbing means (36) which is reciprocably guided in said housing (10) and spring biased toward said working member (11).

4. Impact mechanism according to claim 1, wherein said peripheral wall (52) extends generally longitudinally of the reciprocation direction of said working member, said radially expandible valve collar (48) sliding along and sealing against the peripheral wall (52) during each reciprocation cycle.

5. Impact mechanism according to claim 1 or 2, wherein said housing (10) has a pressure air supply passage (39) therein, said pressure air supply passage being in communication with said depression (51) in said reaction support member (12), said depression and said seal element (47) with said radially expandible valve collar (48) at least partly defining said working chamber (49); and further comprising a feed valve (55) in communication with said pressure air supply passage (39) for selectively closing off said pressure air supply passage to the pressure air when said seal element (47) and said reaction support member (12) separate to such an extent that the seal between said radially expandible valve collar (48) and said peripheral wall (52) of said depression (51) is broken, thereby reducing air consumption of said impact mechanism.

6. In a pneumatic impact mechanism, comprising a working member (11) reciprocably guided in a housing (10) and balanced between a spring (32) and a pressure air supplied working chamber (49); the working chamber (49) being defined by a rear end portion (29) of the working member (11), a reaction support member (12) and an elastic seal element (47) located between the working member (11) and the reaction support member (12), the improvement wherein:

the seal element (47) comprises an annular axially extending valve collar (48) which is radially expandible by the air pressure in the working chamber (49) to an outer diameter exceeding its nominal outer diameter;

the reaction support member (12) comprises a depression (51) located coaxially with said radially expandible valve collar (48), said depression (51) having an inner peripheral wall (52) of a diameter exceeding the nominal outer diameter of said radially expandible valve collar (48);

said radially expandible valve collar (48) during each reciprocation cycle of the working member (11) entering said depression (51) and by radial expansion therein establishing an air tight seal with said peripheral wall (52) of said depression (51);

said housing (10) having a pressure air supply passage (39) therein, said pressure air supply passage being in communication with said depression (51) in said reaction support member (12), said depression and said seal element (47) with said radially expandible valve collar (48) at least partly defining said working chamber (49);

a feed valve (55) in communication with said pressure air supply passage (39) for selectively closing off said pressure air supply passage to the pressure air when said seal element (47) and said reaction support member (12) separate to such an extent that the seal between said radially expandible valve collar (48) and said peripheral wall (52) of said depression (51) is broken, thereby reducing air consumption of said impact mechanism;

said pressure air supply passage (39) comprising an elongated hollow element (37) having its hollow portion in communication with said depression (51), said elongated hollow member (37) having openings (54) therein for receiving pressure air from a pressure air source and for coupling said received pressure air to said working chamber (49); and said feed valve comprising a valve element (55) slidably mounted within said elongated hollow member (37) and being movable relative thereto, said valve member (55) being movable within said elongated hollow member (37) to block said openings (54) when said seal element (47) and said reaction support member (12) separate to such an extent that the seal between said radially expandible valve collar (48) and said peripheral wall (52) of said depression (51) is broken.

7. Impact mechanism according to claim 6, wherein the rear end portion (29) of the working member (11) comprises a substantially flat rearwardly facing surface (46), and said seal element (47) is kept in continuous association therewith by the action of the pressure in the working chamber (49) only.

8. Impact mechanism according to claim 6, wherein said reaction support member (12) comprises a vibration absorbing means (36) which is reciprocably guided in said housing (10) and spring biased toward said working member (11).

* * * * *